US005996729A

United States Patent [19]

Kampf

[11] Patent Number: 5,996,729

[45] Date of Patent: Dec. 7, 1999

[54] SOUND DEFLECTOR

[76] Inventor: Herbert Kampf, 468 Pepperwood Ct., Marco Island, Fla. 33937-3872

[21] Appl. No.: 09/005,763

[22] Filed: Jan. 12, 1998

[51] Int. Cl.[6] ..... G10K 11/00

[52] U.S. Cl. ..... 181/205; 440/71

[58] Field of Search ..... 181/200, 202, 181/204, 205, 210, 235; 440/89, 71, 72

[56] References Cited

U.S. PATENT DOCUMENTS

| | | | |
|---|---|---|---|
| 2,608,363 | 8/1952 | Shumaker . | |
| 3,164,122 | 1/1965 | Fageol . | |
| 3,845,839 | 11/1974 | Eriksson | 181/202 |
| 4,121,683 | 10/1978 | Kohriyama . | |
| 4,122,908 | 10/1978 | Miers et al. . | |
| 4,134,324 | 1/1979 | LeMert . | |
| 4,408,994 | 10/1983 | Blanchard . | |
| 4,733,750 | 3/1988 | Poirier et al. | 181/202 |
| 5,429,324 | 7/1995 | Lynn . | |
| 5,673,643 | 10/1997 | Poppa | 440/71 |

*Primary Examiner*—Khanh Dang
*Attorney, Agent, or Firm*—Oldham & Oldham Co., L.P.A.

[57] ABSTRACT

A sound deflector comprising of a curved deflecting surface, with the deflector being connected to the back of a boat. The sound deflector deflects the sounds emitting from the outboard of a boat away from the passengers in the cockpit. The deflector is composed of sound deflecting material and encompasses the engine over the waterline.

20 Claims, 3 Drawing Sheets

SOUND DEFLECTOR

TECHNICAL FIELD

This invention relates generally to devices used to deflect the sound produced by motor vehicles, and more particularly, to such devices which deflect the sound produced by the engine of recreational boats away from passengers.

BACKGROUND OF THE INVENTION

1. Field of Invention

The present invention relates to deflection of noise caused by the motor of a recreational vehicle. Often passengers in boats have a hard time communicating with one another due to the decibel level of the noise emanating from the engine. Commonly, the more powerful the engine the higher the decibel level. Because outboard engines are not enclosed by any structure of the boat itself, they typically cause more noise to enter the passenger area than do inboards. Inboards generally are quieter than outboards due to the fact they are better insulated, whereas outboards have less insulation and greater exposure to the passenger area of boats. The engine noise can cause several possible problems. First, passengers have a difficult time communicating with one another. During instances in which there is an emergency the need to have a quieter cockpit becomes essential. By decreasing the sounds produced from the engine in the passenger area, the passengers will experience a more pleasant boating experience. Another potential problem is the noise caused by some outboard engines could cause chronic or acute hearing problems. The longer the passengers are exposed to the noise created by the engine the greater the likelihood of hearing loss.

Outboard housings serve to reduce the noise created by these motors, but there is still a demand for a device that reduces the potentially harmful and unpleasant sounds caused by the engine of a boat. A prior art reference having noise control features is U.S. Pat. No. 5,429,324. This patent discloses a marine power propulsion assembly. The invention pertains to an inboard-powered engine which can be mounted in a sound-insulated compartment, and which covers the whole engine while absorbing some of the sound produced by the engine. While this device is effective in stopping some of the noise created from entering the passenger area with inboard engines, there is still a need to reduce the amount of noise entering the passenger area from outboard engines.

SUMMARY OF THE INVENTION

The invention disclosed and claimed herein is a sound deflector for use with boats having an outboard engine. The sound deflector consists of a curved member made from sound deflecting materials. The deflector would encompass at least a portion of the outboard which is above the waterline. The deflector is connected to the stern of the boat, somewhere between the passenger area and the outboard, by the means of screws, bolts, or other devices which are used for attachment known in this field. It is also contemplated that a deflector according to the present invention could be constructed integrally into the boat stern design. Depending in part on the size of the engine the deflector may change in size and radius of curvature. The deflector diverts the sound from the engine away from the passengers.

It is objective of the present invention to present a sound deflector as an adjunct device to lower the decibel level of the engine noise entering in the passenger area, with pre-existing sound deadening devices such as engine encapsulations.

It is another objective of the present invention to keep debris and water stirred by the motor's propeller from entering the passenger area.

It is yet another objective of the present invention to use the sound deflector on a various types of boats. This could include, but is not limited to, boats used for pleasure, waterskiing, fishing, racing. The sound deflector would be used on boats with outboards such as, but not limited to, monohull, multihull, pontoon, or even sailboats with supplemental gas engines.

DETAILED DESCRIPTION OF THE PREFERRED EMBODIMENT

Figure 1:
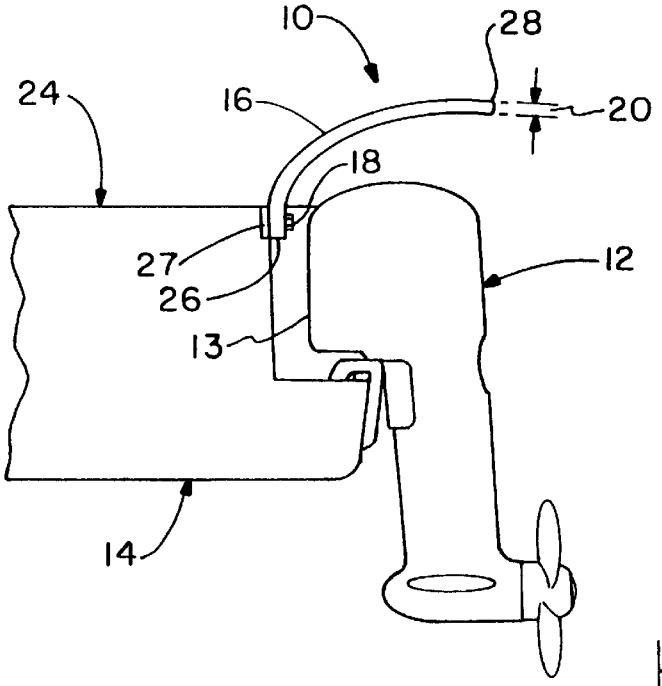
FIG. 1 is a side view of the present invention attached to a boat.

A sound deflector in accordance with the preferred embodiment of the present invention is indicated generally at 10 of FIG. 1. The sound deflector 10 has the general dimensions of a sheet and can be molded into various shapes, sizes, and colors depending on the desired objectives. Some of the various contemplated shapes and sizes are discussed later herein.

Figure 3:
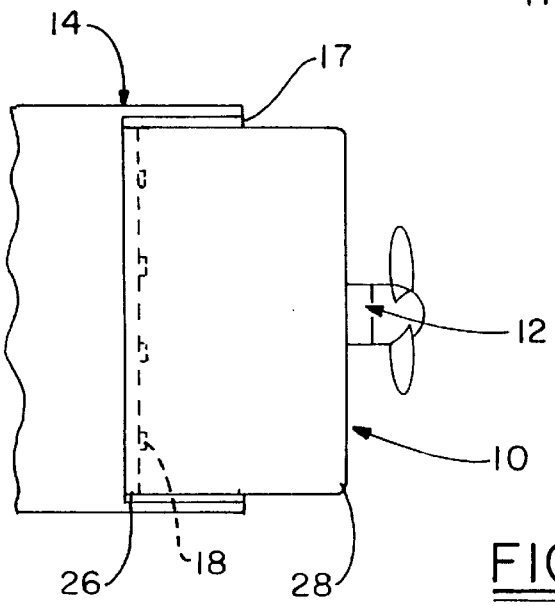
FIG. 3 is a top view of the present invention.

As shown in FIGS. 1 and 3, the preferred embodiment, is a deflector 10 which extends outwardly so at least a portion of the outboard 12 is covered by the deflector 10. The deflector does not need to extend completely over the outboard 12 so long as the deflector 10 serves to deflect the sound away from the passenger area 24.

The preferred embodiment of the deflector 10 has a curved shape with a radius of curvature that varies depending on the size and shape of the outboard 12. Deflector 10 can have a radius of curvature anywhere from about 0.5 feet to about 40 feet, but the preferred range is about 1 foot to about 20 feet. The radius of curvature can be either concave or convex relative to the top of the outboard. The preferred deflector 10 has a curved shape which deflects the sounds created by the outboard 12 to be deflected away from the passenger area 24.

Figure 4:
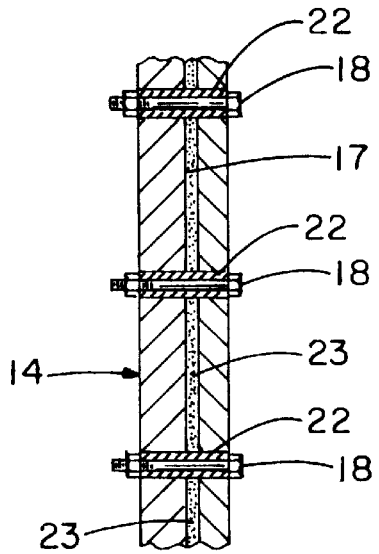
FIG. 4 is a view of the cross section where the bolts are attached to the boat.

To accomplish the purpose of the invention the deflector 10 must be located between the passenger area 24 and the outboard 12. Deflector 10 has an attached end 26 and free end 28. Attached end 26 is connected to the stern 17 of the boat. Deflector 10 can be situated anywhere on the stern, but the preferred location of attachment is on the middle of the stern 17 and between the outboard 12 and the passenger area 24. Deflector 10 is connected to the rear of the boat 14 by the means of a plurality of bolts 18. As shown in FIG. 4, the bolts 18 are secured to the pin bosses 22 which are in turn secured to the walls at a suitable spacing. Deflector 10 can be secured further by the means of an adhesive 23 material. Other possible types of fasteners include permanent or removable means such as screws 32, clamps 78, bolts 18 (as shown in FIG. 4), or other means known in the art. The bolts 18 are located near the bottom of the attached end 26.

Anytime the deflector 10 is attached to a part of the boat 14 or outboard 12 a spacer should be placed between the deflector and the attached member. The spacer 27 can consist of a rubber type material, foam, or any other type of vibration absorbing material. The spacer has two main functions. First, the spacer 27 acts as a vibrational dampening device by absorbing some of the stress caused between the deflector and the attached part. Also, the spacer 27 can be used so the attached member is not scratched due to the deflector rubbing against the attached member.

Figure 2:
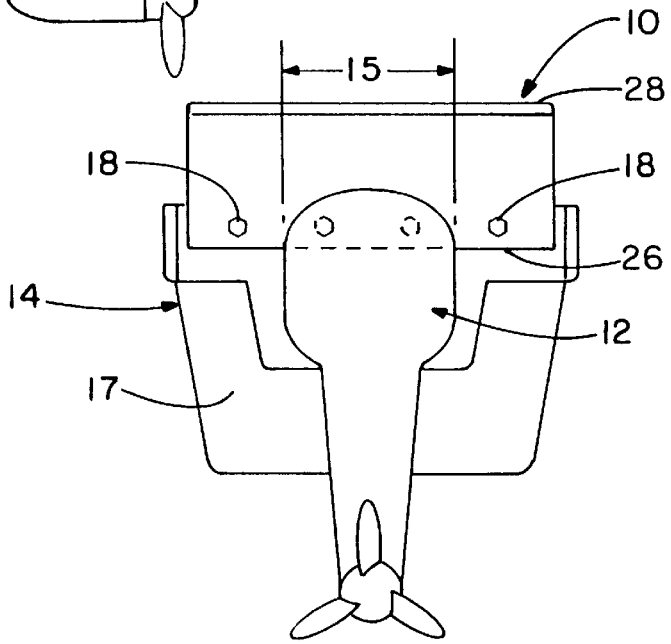
FIG. 2 is a partial frontal view of the present invention showing the deflector attached to a boat.

Deflector 10 has a thickness 20 which ranges from anywhere from 5 mm to 200 mm depending on the need, but the preferred thickness is in a range of about 5 mm to about 80 mm. The preferred width of deflector 10, as shown in FIG. 2, is at least as wide as the width l5 of the outboard. If the width of the deflector 10 is less then the width 15 of the outboard 12 then the deflector 10 will be less effective in deflecting the noise. Deflector 10 is made of one or a combination of fiberglass, aluminum, acrylic, various thermoplastics and other sound deflecting materials. The color of the deflector 10 can also vary to meet the desire of the owner. If the deflector 10 is obstructing the view of the rear of the boat, then the preferred embodiment would be transparent so as to allow the people within the boat to see objects, boats, or a waterskier behind them. The deflector should be a rigid member which can endure high levels of stress caused by the force of vibration by the water and wind. At the same time the deflector should also have some characteristics which allow flexibility to allow the deflector to absorb some of the impact. Much like the wing of an airplane, the deflector should have some flexibility so that it can endure higher levels of stress before failure.

Figure 5:
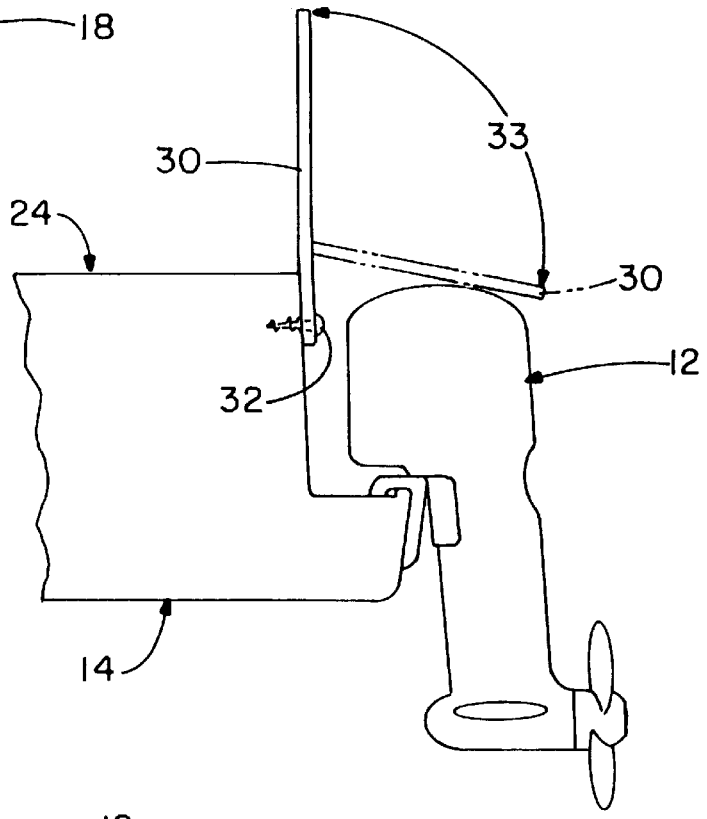
FIG. 5 is a side view of an alternative embodiment of the present invention in the form of a vertical sound deflector.
Figure 6:
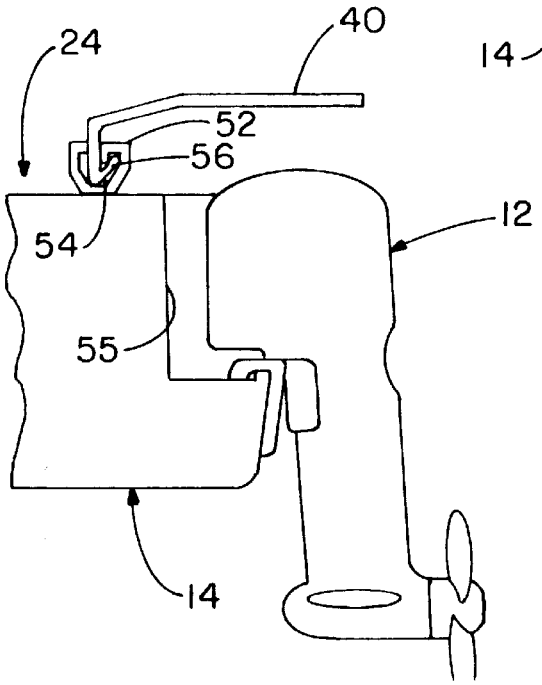
FIG. 6 is a side view of a further embodiment with an alternative means of attachment for the present invention.
Figure 8:
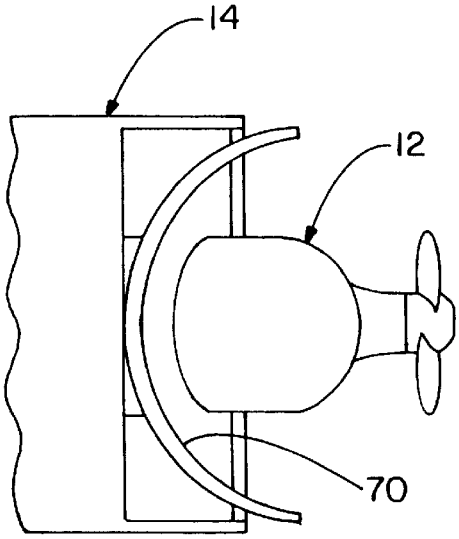
FIG. 8 is a top view of a further means of attachment for the present invention.

As shown in FIG. 5 and FIG. 6, other alternative shapes would be suitable to attain the desired objective of the invention. Such alternatives include but are not limited to, as shown in FIG. 5, a deflector 30 which is perpendicular to the length of the boat and stands in a vertical direction. Other possible variations include the deflector's 30 same shape, a straight member, having an angle 33 ranging from about −45 degrees to about 90 degrees from a horizontal plane defined by the top of the outboard 12. This type of deflector 30 acts as a wall and deflects the sound caused by the engine. As the angle becomes greater then 90 degrees from the top of the outboard, then the deflector 10 becomes less effective and may even deflect the sound into the passenger area. In FIG. 6 the deflector 40 is shown as a member having an angular shape, having two planar surfaces, although any configuration of two or more surfaces is contemplated. The deflector 70, as shown in FIG. 8, is another alternative shape which would deflect sound, and is shown as a cupped shape deflector. This deflector 70 covers at least a portion of the outboard 12 above the waterline, and further extends around at least a portion of the sides of outboard 12. The preferred embodiment of the cupped shape deflector 70 would extend till the deflector 70 encompassed about the middle of each side of the outboard 12. Yet another alternative is the combination of any of the above mentioned shapes and configurations.

Figure 7:
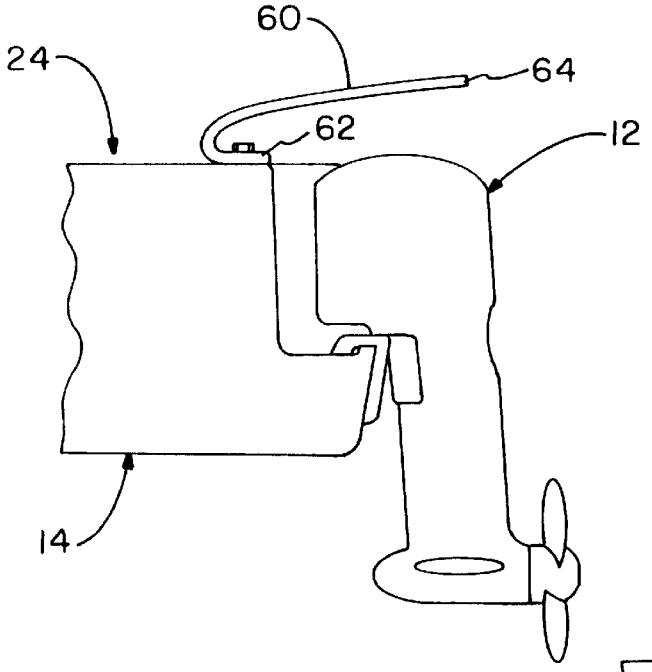
FIG. 7 is a side view of a deflector attached to the top of the stern.
Figure 9:
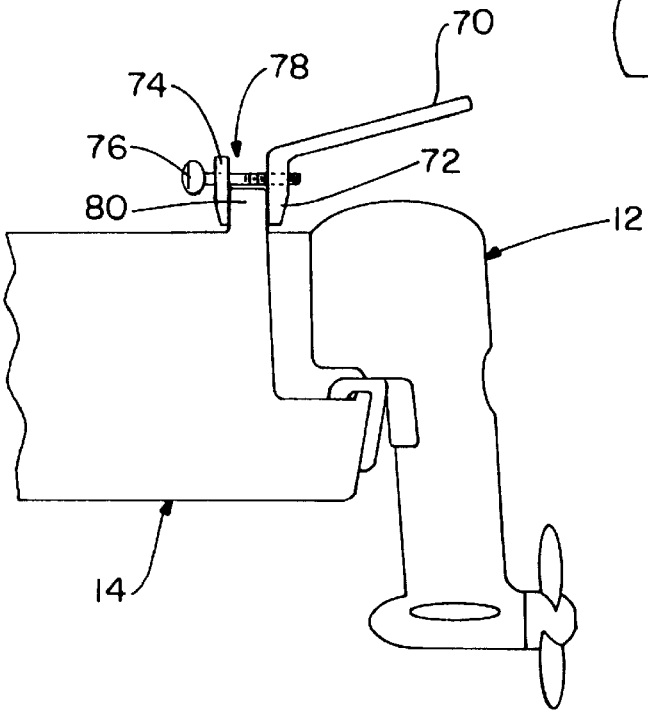
FIG. 9 is a side view of yet another means of attachment for the present invention.

Another possible location which the deflector 30 can be attached to is the front 13 portion of the outboard housing. There are plurality of ways to attach the attached end 26 of the deflector 10 to the desired location. One method of attachment, as shown in FIG. 6, is a tongue and groove attachment. This method of attachment has a male end 56 which slides into a grooved area or female end 54 which is attached to the stern 55 of the boat 14. The male end can be secured further by the means known in the art. Another method of attachment, as shown in FIG. 7, comprises of a deflector 60 which has an attached end 62 connected to the top side of the stern. The attached end 62 has a planar surface which is parallel to the horizontal part of the stern 17. Yet another means for attachment, as shown in FIG. 9, comprises of a clamp 78 device. The clamp 78 would preferably have a right member 72 and a left member 74 which would grip each side of the stern 80. The clamp 78 may be loosened or tightened by turning the handle 76 until the desired grip is achieved.

Although the preferred embodiment of the invention has been described in the foregoing DETAILED DESCRIPTION OF THE PREFERRED EMBODIMENT and illustrated in the accompanying drawings, it will be understood that the invention is not limited to the embodiments disclosed, but is capable of numerous rearrangements, modifications and substitutions of parts and elements without departing from the spirit and scope of the invention.

What is claimed is:

1. A device for deflecting sound from an outboard motor of a boat having a hull with a passenger area and a stern, the outboard motor having a submerged source of propulsion, said device comprising:

a sheet of sound deflecting material; and a means for attaching said sound deflecting sheet to an area of said boat located between said motor and said passenger areas, said sound deflecting sheet extending outward from said boat and being capable of deflecting sound generated by said motor away from said passenger area and said sound deflecting sheet is positioned entirely above said submerged source of propulsion.

2. The sound deflector in accordance with claim 1, wherein said sound deflector consists of a curved shape.

3. The sound deflector in accordance with claim 1, wherein said sound deflector consists of a straight member.

4. The sound deflector in accordance with claim 3, wherein said sound deflector extends outwardly at an angle ranging from about −45 degrees to about 90 degrees from a horizontal plane defined by the top of the outboard.

5. The sound deflector in accordance with claim 2, wherein the radius of curvature varies from about 1 foot to about 20 feet.

6. The sound deflector in accordance with claim 1, wherein said sound deflector consists of a plurality of planar surfaces.

7. The sound deflector in accordance with claim 1, wherein said sound deflector is attached to the end of the boat by at least one of bolts, screws, clamps and adhesives.

8. The sound deflector in accordance with claim 1, wherein said sound deflector includes an attached end and a free end and said attached end is connected to the middle of the stern.

9. The sound deflector in accordance with claim 1, wherein said sound deflector has a male end and a female end and said male end slides into said female end to lock into place.

10. The sound deflector in accordance with claim 1, wherein said sound deflector is fabricated from one of the following materials, fiberglass, aluminum, a thermoplastic, and acrylic.

11. The sound deflector in accordance with claim 4, wherein said sound deflector has a curved shape, with a radius of curvature that varies from 1 foot to 20 feet, said range of angles being measured between the center of the curved member with respect to the top of the outboard.

12. The sound deflector in accordance with claim 1, wherein said sound deflector has a thickness in the range of 5 mm to 80 mm.

13. The sound deflector in accordance with claim 2, wherein said sound deflector has a concave shape with respect to the outboard.

14. The sound deflector in accordance with claim 2, wherein said sound deflector has a convex shape with respect to the outboard.

15. The sound deflector in accordance with claim 1, wherein a spacer is inserted between said sound deflector and said passenger area.

16. The sound deflector in accordance with claim 1, wherein the width of said sound deflector is at least as wide as the outboard.

17. The sound deflector in accordance with claim 1, wherein said sound deflector is fabricated from a transparent material.

18. The sound deflector in accordance with claim 1, wherein said sound deflector is positioned entirely above water level.

19. The sound deflector in accordance with claim 1, wherein said sound deflector is connected to the stern of the boat by a plurality of bolts.

20. The sound deflector in accordance with claim 1, wherein said sound deflector is connected to the stern of the boat by at least one clamp.

* * * * *